US006261388B1

(12) United States Patent
Kubota et al.

(10) Patent No.: US 6,261,388 B1
(45) Date of Patent: Jul. 17, 2001

(54) COLD FORGING STEEL HAVING IMPROVED RESISTANCE TO GRAIN COARSENING AND DELAYED FRACTURE AND PROCESS FOR PRODUCING SAME

(75) Inventors: Manabu Kubota; Tatsuro Ochi; Hideo Kanisawa, all of Muroran; Atsushi Murakami; Masao Ishida, both of Wako, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/314,733

(22) Filed: May 18, 1999

(30) Foreign Application Priority Data

May 20, 1998 (JP) ..... 10-153674

(51) Int. Cl.[7] ..... C22C 38/32; C22C 38/26; C22C 38/28; C21D 8/06

(52) U.S. Cl. ..... 148/330; 148/333; 148/598

(58) Field of Search ..... 148/328, 330, 148/333, 654, 598

(56) References Cited

U.S. PATENT DOCUMENTS 4,537,644 * 8/1985 Tominaga et al. ..... 148/333
5,186,768 * 2/1993 Nomoto et al. ..... 148/333

FOREIGN PATENT DOCUMENTS 52-114545 9/1977 (JP) .
61-217553 9/1986 (JP) .
61-253347 11/1986 (JP) .
63-64495 12/1988 (JP) .
5-63524 9/1993 (JP) .
5-339676 12/1993 (JP) .
8-60245 3/1996 (JP) .

* cited by examiner

*Primary Examiner*—Deborah Yee
(74) *Attorney, Agent, or Firm*—Kenyon & Kenyon

(57) ABSTRACT

A cold forging steel excellent in grain coarsening prevention and delayed fracture resistance and method of producing the same are provided that enable omission of a step of annealing or spheroidization annealing before cold forging and improvement of delayed fracture resistance of a high-strength component used with a heat-treated surface. The cold forging steel is a steel of a specified composition having dispersed in the matrix thereof particles of not greater than 0.2 $\mu$m diameter of one or more of TiC, Ti(CN), NbC, Nb(CN) and (Nb, Ti)(CN) in a total number of not less than 20/100 $\mu m^2$. The method of producing a cold forging steel includes the steps of heating this steel to not lower than 1050° C., hot-rolling the steel into steel wire or steel bar, and slowly cooling the steel at a cooling rate of not greater than 2 C./s during cooling to a temperature not higher than 600° C. to obtain a steel having dispersed in the matrix thereof particles of not greater than 0.2 $\mu$m diameter of one or more of TiC, Ti(CN), NbC, Nb(CN) and (Nb, Ti)(CN) in a total number of not less than 20/100 $\mu m^2$.

4 Claims, 2 Drawing Sheets

COLD FORGING STEEL HAVING IMPROVED RESISTANCE TO GRAIN COARSENING AND DELAYED FRACTURE AND PROCESS FOR PRODUCING SAME

BACKGROUND OF THE INVENTION

1. Field of the Invention

The present invention relates to a cold forging steel excellent in grain coarsening prevention and delayed fracture resistance and a method of producing the same.

2. Description of the Related Art

Cold forging (including roll-forging) is utilized for bolts, gear components, shafts and numerous other products because it enables fabrication of products with excellent surface quality and dimensional precision, is lower in cost than hot forging, and is excellent in yield. In the cold forging of such products, use is made of medium-carbon machine structural carbon steels and alloy steels such as those specified by S G 4051, JIS G 4052, JIS G 4104, JIS G 4105, JIS G 4106 and the like. The process usually includes a step of annealing or spheroidization annealing before the cold forging, in the manner of, for example: hot rolling—annealing—cold forging—quench-hardening—tempering. This is because the high as-rolled hardness of medium-carbon carbon steels and alloy steels like those listed above is a cause of various production-related problems, including high cost owing to heavy wear of the cold forging tool during the shaping of components such as bolts and occurrence of cracking during component shaping owing to the low ductility of the blank.

As annealing involves considerable energy, labor and equipment costs, however, a need is felt for a material and process that enable omission of the annealing step. This has led to the development of numerous so-called low-carbon boron steels that enable omission of the annealing step by reducing the carbon and alloying element content of the steel to achieve lower as-hot-rolled hardness and improved ductility and that add a small amount of boron to make up for the degradation in quench-hardening performance caused by the reduced content of Cr, Mo and other alloying elements. Such steels are taught by, for example, JP-A-(unexamined published Japanese patent application)5-339676, JP-B-(examined published Japanese patent application)5-63624 and JP-A-61-253347. Although addition of a small amount of boron (B) improves the quench-hardening performance, this effect is lost when N is present in the steel in solid solution because the B combines with N to form BN. Ordinarily, therefore, Ti is added to fix the N in the steel as TiN and thereby suppress formation of BN.

As the need for components with higher strength has increased, attempts have been made to apply such low-carbon boron steels to higher strength components. Since low-carbon boron steels are low in C and alloying elements, however, they sustain a decline in delayed fracture property when subjected to heat treatment for achieving a tensile strength of 1000 MPa or higher. It is known that an attempt to obtain high strength by conducting low-temperature tempering results in degraded delayed fracture properties. However, when the amount of added C is increased or an SCR, SCM or other such alloy steel is used in order to secure high strength and bring the delayed fracture strength up to a practical level even with high-temperature tempering, the resulting increase in the steel hardness makes it impossible to eliminate the annealing step. Although low-carbon boron steels that enable omission of annealing are economical, they require the tempering temperature to be lowered for obtaining high strength. But this degrades the delayed fracture strength and causes problems from the practical aspect. Application to high-strength products is therefore difficult.

In response to the call for application of boron steels to high-strength components, JP-A-8-60245, for example, teaches a steel reduced in impurity content so has to have delayed fracture property on a par with an alloy steel. When this boron steel was evaluated using a machined-surface test piece, it was in fact found to exhibit a delayed fracture property superior to an alloy steel. However, when the steel was used to fabricate a component on an actual production line, and the delayed fracture property was evaluated from the heat-treated surface condition, it was found that the boron steel component was inferior to an alloy steel in delayed fracture property. The technology taught by JP-A-8-60245 is therefore limited in its ability to respond to the need for higher strength components.

In addition to the foregoing problems, a boron steel is also more likely than an annealed steel to sustain abnormal coarsening of specific austenite grains during heating for quench-hardening. A component that has experienced grain coarsening is liable to have low dimensional precision owing to quench-hardening distortion, reduced impact value and fatigue life, and, particularly in a high-strength component, degraded delayed fracture property. Application of a boron steel to a high-strength component therefore requires suppression of grain coarsening and crystal grain refinement. For suppressing the grain coarsening, it is effective to finely disperse a large quantity of particles that pin grain boundary movement.

Methods have been proposed for preventing the aforesaid grain coarsening of boron steel. JP-A-61-217553, for example, aims to pin the grain boundaries by defining the Ti and N contents as $0.02<Ti-3.42N$ so as to generate TiC. However, it is not possible to prevent grain coarsening merely by defining composition because the TiC cannot be finely dispersed. On the other hand, JP-B-63-64495, for instance, aims to prevent grain coarsening by keeping N content to a very low value of not greater than 0.0035% and subjecting the resulting composition having an excess of Ti relative to N to rolling under low-temperature heating. However, prevention of grain coarsening cannot be achieved unless the TiC, Ti(CN) precipitation condition is optimized before heating for quench-hardening.

JP-A-52-114545, for example, puts TiC into solid solution at the material stage so that fine precipitation of TiC will first occur during heating for quench-hardening. When pinning particles precipitate during heating for quench-hardening, however, the amount of TiC precipitation is affected by the heating rate during heating for quench-hardening or heating for carburization. As this makes the expression of the pinning effect unstable and, even when the same material is used, a high probability arises of the coarsening prevention being degraded by a mere change in component size or the heat-treatment furnace. A problem therefore persists regarding quality stability in actual production.

The aforesaid conventional methods cannot achieve a delayed fracture property of the actual component equal to or better than that of an alloy steel when the annealing or spheroidization annealing step before cold forging is omitted and heat treatment is conducted for imparting high strength.

SUMMARY OF THE INVENTION

An object of this invention is to overcome the aforesaid problems of the prior art and to provide a cold forging steel excellent in grain coarsening prevention and delayed fracture resistance and method of producing the same.

During their research for achieving this object, the inventors discovered the following facts (A)–(D) regarding the effects of various factors on the delayed fracture property at the heat-treated surface of an actual component.

(A) That the surface properties of an actual component strongly affect its delayed fracture property, specifically that an actual bolt with adhered heat-treatment scale (heat-treated surface) and a test piece removed of the surface layer by cutting, grinding or other such machining (machined surface) exhibit markedly different properties when subjected to delayed fracture testing under identical conditions, with the actual component with adhered heat-treatment scale exhibiting inferior delayed fracture property.

(B) That delayed fracture property at the heat-treated surface can be improved by adding Cr within a certain optimum range so as to cause the scale formed during heat treatment of the component to become a dense scale enriched in Cr, thereby increasing corrosion resistance so as to reduce the amount of hydrogen produced in the process of corrosion of the scale and the steel surface inside the scale.

(C) That when a boron steel is applied to a high-strength component such as a bolt having a tensile strength of 1000 MPa or higher, improvement of delayed fracture property requires the P and S contents to be limited to not more than prescribed values and requires prevention of grain coarsening.

(D) That fine TiC, Ti(CN), NbC, Nb(CN) and (Nb, Ti)(CN) particles are effective as pinning particles for preventing grain coarsening, that the grain coarsening property is very closely related to the size and dispersion state (number of precipitated particles) of these precipitates, and that for stably securing the pinning effect of the precipitates it is necessary to finely precipitate at least a prescribed amount of particles of one or more of TiC, Ti(CN), NbC, Nb(CN) and (Nb, Ti)(CN) before heating for quench-hardening.

The present invention is based on this new knowledge.

In a first aspect, the present invention enables a marked improvement of delayed fracture property after production into an actual component by defining content of C as 0.10–0.40%, Si as not more than 0.15% and Mn as 0.30–1.00% to secure component strength after quench-hardening and tempering, limiting content of P to not more than 0.015% (including 0%) and S to not more than 0.015% (including 0%) to improve delayed fracture property, limiting content of B to 0.0003–0.0050% to secure quench-hardenability, and defining content of Cr as 0.50–1.20% to improve delayed fracture property at the heat-treated surface. Further, N content can be limited to not more than 0.0100% (including 0%) and Ti content be defined as 0.020–0.100% to produce TiC and Ti(CN) utilized as pinning particles for preventing grain coarsening. By making the total number of particles of not greater than 0.2 $\mu$m diameter of one or both of TiC and Ti(CN) in the matrix not less than 20/100 $\mu m^2$, the pinning effect can be maximized to provide a cold forging steel enabling prevention of grain coarsening during heating for quench-hardening and refinement of old austenite grains.

In a second aspect, the present invention defines, in addition to the components of the first aspect, a Nb content of 0.003–0.100% and makes the total number of particles of not greater than 0.2 $\mu$m diameter of one or more of TiC, Ti(CN), NbC, Nb(CN) and (Nb, Ti)(CN) in the matrix not less than 20/100 $\mu m^2$, thereby providing a cold forging steel enabling prevention of grain coarsening.

In a third aspect, the present invention defines, in addition to the components of the first and second aspects, one or both of a V content of 0.05–0.30% and a Zr content of 0.003–0.100%, thereby enabling further refinement of old austenite grains, and makes the total number of particles of not greater than 0.2 $\mu$m diameter of one or more of TiC, Ti(CN), NbC, Nb(CN) and (Nb, Ti)(CN) in the matrix not less than 20/100 $\mu m^2$, thereby providing a cold forging steel enabling prevention of grain coarsening.

In a fourth aspect, the present invention provides a method of producing a cold forging steel comprising the steps of heating a steel having the composition components of the first, second or third aspect to not lower than 1050° C., thereby once causing TiC, Ti(CN), NbC, Nb(CN) and (Nb, Ti)(CN) to enter solid solution in the matrix, hot-rolling the steel into steel wire or steel bar, softening the steel by slow cooling at a cooling rate of not greater than 2° C./s during cooling to a temperature not higher than 600° C., and dispersing fine particles of not greater than 0.2 $\mu$m diameter of one or more of TiC, Ti(CN), NbC, Nb(CN) and (Nb, Ti)(CN) in the matrix in a total number of not less than 20/100 $\mu m^2$.

DESCRIPTION OF THE PREFERRED EMBODIMENTS

The reasons for the limitations on the composition components in the present invention will now be explained.

Carbon (C) is an element effective for imparting strength to the steel. When the C content is less than 0.10%, the required tensile strength cannot be obtained, and when the C content is greater than 0.40%, the cold forgeability is degraded and the annealing or spheroidization annealing step before cold forging cannot be omitted. Moreover, since the component ductility and toughness are degraded and the delayed fracture property also tends to be degraded, the C content must be in the range of 0.10–0.40%. It is preferably 0.20–0.30%.

Silicon (Si) is an element effective for deoxidization as well as for imparting a required strength and quench-hardenability to the steel and improving resistance to temper-softening. However, when present in excess of 0.15%, it degrades toughness and ductility. It also degrades cold forgeability by increasing hardness. Si content must therefore be kept to not greater than 0.15% and is preferably not greater than 0.10%.

Manganese (Mn) is an element effective for deoxidization as well as for imparting a required strength and quench-hardenability to the steel. At a content of less than 0.30%, its effect is insufficient, and at a content greater than 1.00%, it degrades cold forgeability by increasing hardness. Mn content must therefore be in the range of 0.30–1.00% and is preferably in the range of 0.40–0.70%.

Phosphorus (P) is an element that, by increasing resistance to deformation and degrading toughness during cold forging, degrades cold forgeability. As it also degrades delayed fracture property by embrittling the grain boundaries of the component after quench-hardening and tempering, its content is preferably made as low as possible. P content must therefore be limited to not more than 0.015% and is preferably not more than 0.010%.

Sulfur (S) is an element that promotes cracking during cold forging and therefore degrades cold forgeability. As, like P, it also degrades delayed fracture property by embrittling the grain boundaries of the component after quench-hardening and tempering, its content is preferably made as low as possible. S content must therefore be limited to not more than 0.015% and is preferably not more than 0.010%.

Chromium (Cr) is an element effective for imparting strength and quench-hardenability to the steel and for improving resistance to temper-softening. It is particularly an element that markedly improves delayed fracture property at the heat-treated surface. Cr has the effect of making the scale formed during heat treatment a dense scale enriched in Cr, thereby increasing corrosion resistance so as to reduce the amount of hydrogen produced in the process of corrosion of the scale and thus improve the delayed fracture property. The effect of Cr content on delayed fracture property is shown in FIG. 1 for the case of heat-treatment for obtaining a tensile strength of around 1350 MPa.

Figure 1:
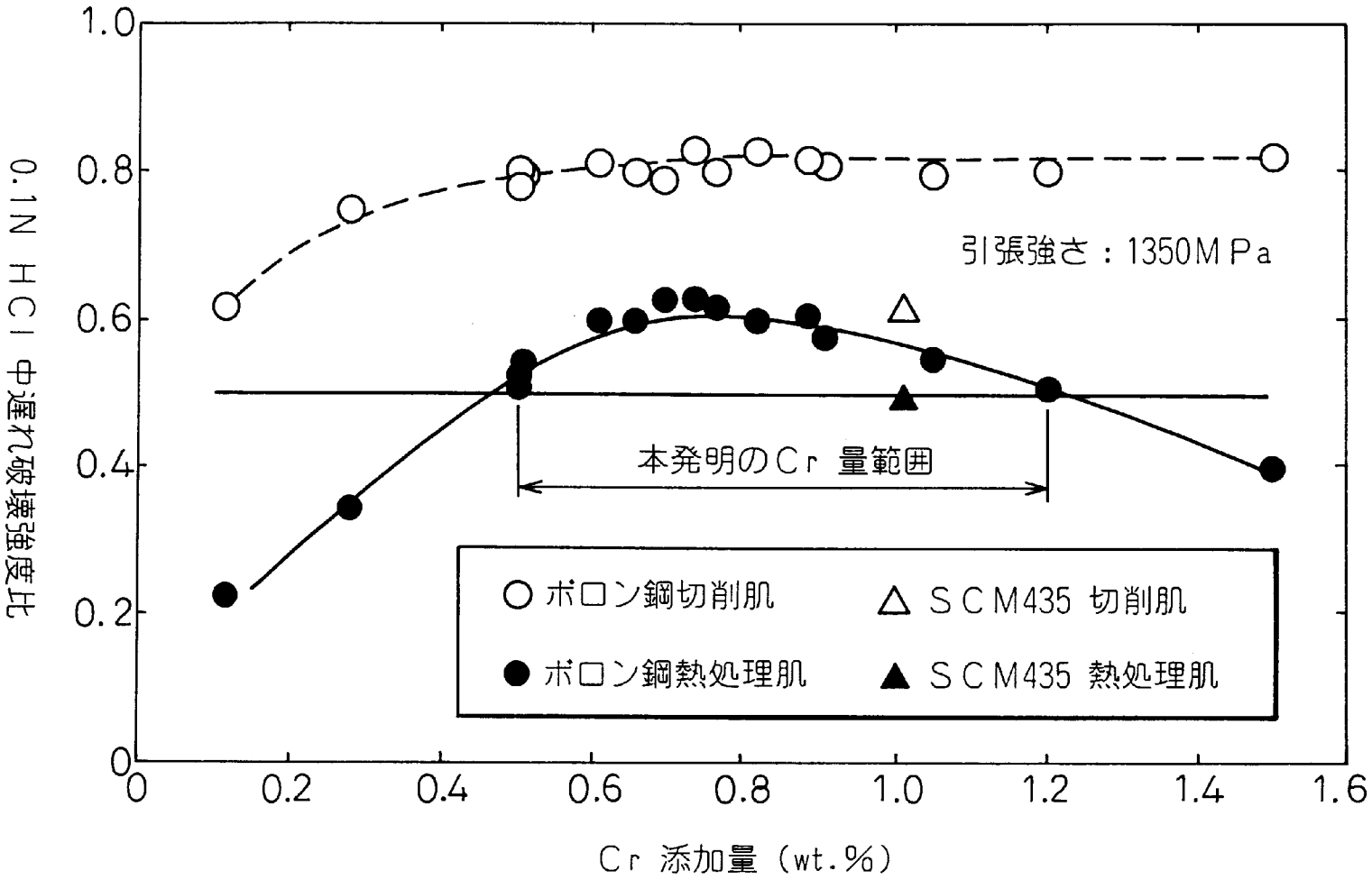
FIG. 1 is a graph showing an example of results obtained by analyzing the effect of Cr content on the delayed fracture property at the heat-treated surface.

Although FIG. 1 shows the test results in 0.1N HCl, substantially the same pattern is exhibited in 1% $H_2SO_4$. As is clear from FIG. 1, the effect of Cr content on delayed fracture property at the heat-treated surface is great. A sufficient improvement in delayed fracture property is not obtained when the content is less than 0.50%, and when the content exceeds 1.2%, the cold forgeability is degraded owing to increased hardness, while the delayed fracture property is degraded rather than improved owing to promotion of grain boundary oxidation of the surface layer formed during heat treatment. This tendency increases with increasing component strength. The amount of added Cr must therefore be in the range of 0.50–1.20% and is preferably in the range of 0.60–0.90%.

Boron (B) is an element effective for imparting quench-hardenability to the steel when added in a small amount. This effect is insufficient at a content of less than 0.0003% and saturates when the content exceeds 0.0050%. The content must therefore be in the range of 0.0003–0.0050%. The preferable range is 0.0010–0.0030%.

Nitrogen (N) combines with B to form BN. This is deleterious in the case of a B-added steel such as that of the present invention because it lowers the quench-hardenability improving effect of B. Moreover, when N combines with Ti, coarse TiN contributing substantially no pinning effect is formed and the amount of Ti available for forming Ti-containing carbonitrides is reduced. As this reduces the amount of fine precipitate, the N content is preferably made as low as possible. Thus the main aim in keeping the N content as low as possible is to control grain coarsening and, as pointed out later, the amount of Ti added can be reduced when the N content is low. As it is difficult to completely remove N in an actual production process, however, the N content is defined as not greater than 0.0100%. The preferable range is not greater than 0.0050%.

Ti (titanium) is an element that, by combining with C and N to form TiC and Ti(CN), is effective for grain refinement and suppression of grain coarsening. When it is added together with B, formation of BN is suppressed because N enters the steel in solid solution in the form of TiN and Ti(CN). Ti is therefore an element effective for enhancing the quench-hardenability improving effect of B. However, these effects are insufficient at a content of less than 0.020% and saturate at a content exceeding 0.100%. A content exceeding 0.100% also degrades cold forgeability by increasing hardness. The Ti content must therefore be in the range of 0.020–0.100%. The preferable range is 0.025–0.50%.

In order to fix all sol N in the steel in the form of TiN, it is necessary to increase the Ti content in accordance with the N content, and in order to secure an adequate amount of fine TiC and Ti(CN) effective for grain boundary pinning, it is necessary to increase the amount of Ti in accordance with the N content. Ti must be added in excess of at least 3.4N %.

Niobium (Nb) is an element that by combining with C and N to form NbC, Nb(CN) and (Nb, Ti)(CN) is effective for grain refinement and suppression of grain coarsening. When Nb is added together with Ti, almost all of it forms stable (Nb, Ti)(CN), whereby a stable pinning effect can be obtained. This effect is insufficient at a content of less than 0.003% and saturates at a content exceeding 0.100%. A content exceeding 0.100% also degrades cold forgeability by increasing hardness. The Nb content must therefore be in the range of 0.003–0.100%. The preferable range is 0.005–0.030%.

Vanadium (V) is an element that by combining with C and N to form VC and VN is effective for grain refinement. This effect is insufficient at a content of less than 0.05% and saturates at a content exceeding 0.30%. A content exceeding 0.30% also degrades cold forgeability by increasing hardness. The V content must therefore be in the range of 0.05–0.30%. The preferable range is 0.10–0.20%.

Zr (zirconium) is an element that by combining with C and N to form ZrC and ZrN is effective for grain refinement. This effect is insufficient at a content of less than 0.003% and saturates at a content exceeding 0.100%. A content exceeding 0.100% also degrades cold forgeability by increasing hardness. The Zr content must therefore be in the range of 0.003–0.100%. The preferable range is 0.005–0.030%.

Although V and Zr are not required elements in the present invention, they can be added as required for the purpose of grain refinement.

Although the present invention does not define an amount of Al to be added, Al is an element effective for deoxidization of the steel and can therefore be included in an amount normally used for deoxidization. Ordinarily, the Al content is about 0.010–0.050%. When one or more other elements (Si, Mn, Ti, Zr etc.) are added as deoxidizers in place of Al, however, addition of Al is not absolutely necessary.

The dispersed state of TiC, Ti(CN), NbC, Nb(CN) and (Nb, Ti)(CN) in the matrix will now be explained.

Figure 2:
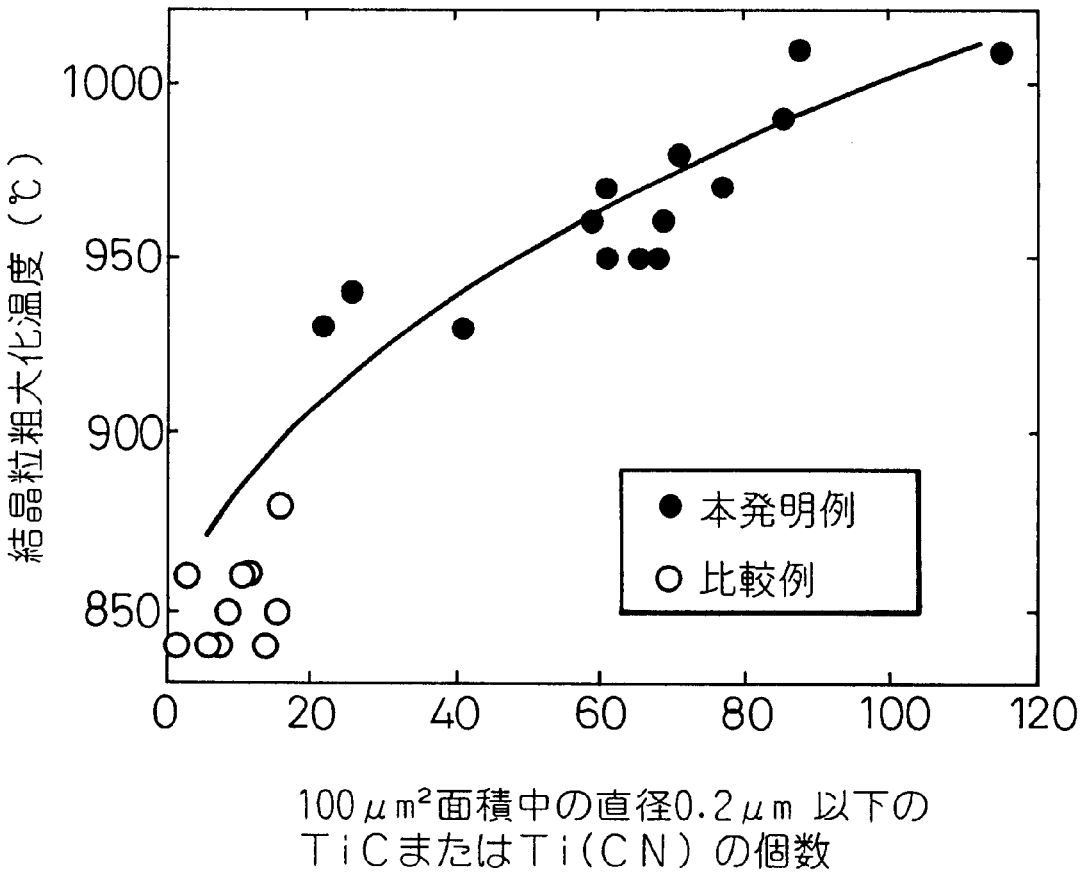
FIG. 2 is a graph showing an example of results obtained by analyzing the relationship between the total number of fine TiC or Ti(CN) particles in the matrix of the steel before heating for quench-hardening and the grain coarsening temperature.

For suppressing the grain coarsening, it is effective to finely disperse a large quantity of particles for pinning the grain boundaries. A smaller particle diameter and larger particle quantity is preferable because it increases the number of pinning particles. The relationship between fine TiC, Ti(CN) and grain coarsening temperature is shown in FIG. 2. The relationship of FIG. 2 also holds for NbC, Nb(CN) and (Nb, Ti)(CN), which have similar effect.

As seen in FIG. 2, the grain coarsening property is very closely related to the number of finely precipitated particles. When particles of not greater than 0.2 $\mu$m diameter of one or more of TiC, Ti(CN), NbC, Nb(CN) and (Nb, Ti)(CN) are dispersed in the matrix in a total number of not less than 20/100 $\mu m^2$, no grain coarsening occurs in the practical temperature range of heating for quench-hardening or heating for carburization and excellent grain coarsening prevention is obtained. It is therefore necessary for particles of not greater than 0.2 $\mu$m diameter of one or more of TiC, Ti(CN), NbC, Nb(CN) and (Nb, Ti)(CN) to be dispersed in the matrix in a total number of not less than 20/100 $\mu m^2$.

The invention production method will now be explained.

A steel comprising the aforesaid invention composition components is melted in a converter, electric furnace or the like, adjusted in composition, and passed through a casting step and, if necessary, a slab rolling step to obtain a rolled material. Further improved characteristics can be obtained by subjecting the casting to soaking and dispersion treatment before the slab rolling step by holding it at a temperature of about 1,200–1,350° C. for several hours. This is because this treatment reduces segregation of P and other impurity elements, thereby further improving the delayed fracture property of the actual component, and also enables coarse precipitates precipitated in the casting step to be once put into solid solution, thereby making it easier for precipitates to enter the matrix in solid solution in the following step.

Next, the rolled material is heated to a temperature of 1050° C. or higher. Under heating conditions of a temperature lower than 1050° C., TiC, Ti(CN), NbC, Nb(CN) and (Nb, Ti)(CN) cannot once be put into solid solution in the matrix, making it impossible to obtain a steel having one or more of TiC, Ti(CN), NbC, Nb(CN) and (Nb, Ti)(CN) finely precipitated therein after hot rolling. Moreover, when much coarse TiC, Ti(CN), NbC, Nb(CN) or (Nb, Ti)(CN) that could not enter solid solution remains, it degrades the ductility of the component and has an adverse effect on the delayed fracture property.

When many coarse precipitates are present, moreover, they further promote coarsening by acting as precipitation nuclei during cooling after rolling. This makes fine dispersion of pinning particles in the matrix difficult. The heating temperature is therefore preferably made as high as possible. The preferable range is 1150° C. and higher.

Next, the rolled material heated to 1050° C. or higher is hot-rolled into steel wire or steel bar and then slowly cooled at a cooling rate of not greater than 2° C./s during cooling to a temperature not higher than 600° C. Under cooling conditions exceeding 2° C./s, the time period of passage through the precipitation temperature ranges of TiC, Ti(CN), NbC, Nb(CN) and (Nb, Ti)(CN) is too short to obtain a sufficient amount of precipitation and, as a result, it becomes impossible to obtain a steel containing a large quantity of finely precipitated TiC, Ti(CN), NbC, Nb(CN) and/or (Nb, Ti)(CN) effective as pinning particles.

In addition, a rapid cooling rate increases the hardness of the rolled material. As this degrades the cold forgeability, the cooling rate is preferably made as slow as possible. The preferable range is not greater than 1° C./sec. After hot-rolling, cooling to a still lower temperature range (500° C. or below) is preferably conducted slowly at a cooling rate of 2° C./s. When slow cooling is conducted to a low temperature range, the rolled material is further softened and improved in cold forgeability.

EXAMPLE

The present invention will now be further explained with reference to an example.

Each of molten converter steels of the compositions shown in Table 1 was continuously cast, subjected to soaking and dispersion treatment as required, and slab-rolled into a 162 mm square rolled material. The rolled material was then heated to a temperature not lower than 1050° C. and hot-rolled into steel bar or steel wire of a diameter of 5–50 mm. For comparison, the heating of a portion was conducted at temperature below 1050° C. Next, slow cooling was conducted using a heat-retention cover installed after the rolling line. For comparison, a portion was not subjected to slow cooling.

To examine the dispersed state of TiC, Ti(CN), NbC, Nb(CN) and/or (Nb, Ti)(CN) effective as pinning particles, precipitates present in the steel bar or steel wire matrix were sampled by the extraction replica method and observed with a transmission electron microscope. Around 20 fields were observed at 15,000 magnifications, the total number of 0.2 $\mu$m and smaller diameter particles of TiC, Ti(CN), NbC, Nb(CN) and (Nb, Ti)(CN) per field was counted and converted to number per 100 $\mu m^2$.

The grain coarsening temperature of the steel bar or steel wire produced by the foregoing process was determined. The rolled material was drawn at an area reduction of 70%, heated for 30 min to 840–1200° C. and water-quenched. A cut surface was polished/corroded and the old austenite grain diameter was observed to determine the coarse grain forming temperature (grain coarsening temperature).

Quench-hardening of bolts and other actual components is usually conducted in the $A_{C3}$-900° C. temperature range. A material with a coarse grain forming temperature below 900° C. was therefore evaluated as inferior in grain coarsening property. The old austenite granularity was measured in conformity with JIS G 0551. About 10 fields were observed at 400 magnifications and coarsening was judged to have occurred if even one coarse grain of a granularity number of 5 or below was present.

The delayed fracture property of the materials was then investigated. After 70% cold drawing, the material was machined to obtain a delayed fracture test piece with an annular V-notch. The test piece was then imparted with 1350 MPa class tensile strength by 900° C.×30 min heating/quench-hardening followed by tempering to fabricate a delayed fracture test piece with a heat-treated surface closely resembling the surface of an actual component. This delayed fracture test piece was soaked in 0.1N HCl and the time to fracture under different load stresses was measured. The test was continued for a maximum of 200 h and the maximum load stress at which fracture did not occur within 200 h was determined. The value obtained by dividing the maximum load at which fracture did not occur within 200 h by the fracture stress in air was defined as the "delayed fracture strength ratio" and used as an index of the delayed fracture property.

The delayed fracture strength ratio of SCM435 currently commonly used for 1000–1400 MPa class tensile strength components is around 0.5. A material having a delayed fracture strength ratio of less than 0.5 was therefore evaluated as inferior in delayed fracture property. The granularity of the test pieces subjected to the delayed fracture test was investigated. In the case of uniform grains, the average granularity of the matrix was measured. In the case of mixed grains or when coarse grains were present, the granularity number of the largest grain in the observed field was also determined. Measurement of old austenite granularity was measured by the same method as used to determine the grain coarsening temperature.

The results of the tests are shown in Tables 2, 3 and 4.

Symbols N and O in Table 2 indicate comparative examples whose Ti or N content is outside the range of the present invention and that are therefore inferior in grain coarsening property owing to a deficiency in the number of finely precipitated particles of TiC, Ti(CN), NbC, Nb(CN) and/or (Nb, Ti)(CN). Symbols V, X and Y indicate comparative examples in which TiC, Ti(CN), NbC, Nb(CN) and/or (Nb, Ti)(CN) failed to once enter the matrix in solid solution owing to low heating temperature for rolling and that are therefore inferior in grain coarsening property because a steel having fine precipitates precipitated during cooling after hot rolling could not be obtained.

Symbols W and Z indicate comparative examples that are inferior in grain coarsening property owing to a deficiency of fine precipitates caused by too high a cooling rate after rolling.

The delayed fracture properties of the rolled materials of Table 2 when adjusted to around 1350 MPa and 1200 MPa are shown in Tables 3 and 4, respectively. Symbols P, Q and T in Table 3 indicated comparative examples that are inferior in grain coarsening property because the amount of added Cr is outside the range of the present invention. Symbols R and S indicate comparative examples that are inferior in grain coarsening property because the P or S content is outside the range of the present invention.

The materials that are inferior in grain coarsening property (Symbols N, O, V, W, X, Y and Z) are inferior in delayed fracture property owing to the formation of coarse particles in the delayed fracture test piece. As the tensile strength of the materials in Table 4 is in the neighborhood of 1200 MPa, their delayed fracture property is better than those in Table 3. Steel No. 21 in Table 1 and the material indicated by Symbol U in Tables 2 and 3 are examples of widely used alloy steels that do not permit annealing to be omitted. As can be seen from the tables, the materials that satisfy all of the conditions prescribed by the present invention exhibit grain coarsening prevention and delayed fracture resistance superior to those of the comparative examples.

When the cold forging steel and the production method of the present invention are adopted, the annealing step before cold forging can be omitted and the degree of degradation of dimensional precision and the amount of reduction of impact value and fatigue strength owing to quench-hardening distortion caused by grain coarsening during heat treatment are less than in the prior art. In addition, materials can be provided for bolts, gear components, shafts and the like that are especially superior in delayed fracture property in the actual component used with a heat-treated surface.

TABLE 1

| | Steel No. | C | Si | Mn | P | S | Cr | B | Al | Ti | N | Others |
|---|---|---|---|---|---|---|---|---|---|---|---|---|
| Invention | 1 | 0.23 | 0.05 | 0.50 | 0.007 | 0.004 | 0.70 | 0.0020 | 0.027 | 0.036 | 0.0033 | |
| | 2 | 0.24 | 0.10 | 0.80 | 0.001 | 0.010 | 0.50 | 0.0012 | 0.020 | 0.100 | 0.0037 | |
| | 3 | 0.19 | 0.07 | 0.48 | 0.010 | 0.005 | 0.89 | 0.0023 | 0.035 | 0.036 | 0.0036 | |
| | 4 | 0.11 | 0.15 | 0.30 | 0.008 | 0.001 | 1.05 | 0.0050 | 0.017 | 0.032 | 0.0037 | |
| | 5 | 0.38 | 0.09 | 0.99 | 0.005 | 0.015 | 0.61 | 0.0003 | 0.043 | 0.020 | 0.0013 | |
| | 6 | 0.14 | 0.01 | 0.35 | 0.015 | 0.005 | 1.20 | 0.0025 | 0.011 | 0.040 | 0.0050 | |
| | 7 | 0.24 | 0.08 | 0.45 | 0.007 | 0.007 | 0.77 | 0.0015 | — | 0.034 | 0.0031 | |
| | 8 | 0.20 | 0.06 | 0.44 | 0.005 | 0.004 | 0.66 | 0.0019 | 0.025 | 0.027 | 0.0036 | Nb: 0.003 |
| | 9 | 0.25 | 0.06 | 0.39 | 0.014 | 0.002 | 0.74 | 0.0025 | 0.030 | 0.026 | 0.0038 | Nb: 0.019 |
| | 10 | 0.19 | 0.05 | 0.35 | 0.009 | 0.008 | 0.82 | 0.0010 | 0.035 | 0.039 | 0.0032 | Nb: 0.010<br>V: 0.06 |
| | 11 | 0.23 | 0.03 | 0.49 | 0.012 | 0.006 | 0.50 | 0.0012 | 0.010 | 0.029 | 0.0026 | V: 0.16 |
| | 12 | 0.22 | 0.10 | 0.30 | 0.015 | 0.001 | 0.91 | 0.0022 | 0.008 | 0.035 | 0.0041 | Nb: 0.012<br>Zr: 0.007 |
| | 13 | 0.22 | 0.05 | 0.57 | 0.009 | 0.003 | 0.51 | 0.0019 | 0.019 | 0.030 | 0.0038 | Zr: 0.018 |
| Comparison | 14 | 0.22 | 0.10 | 0.83 | 0.012 | 0.010 | 0.50 | 0.0024 | 0.026 | 0.040 | 0.0108* | |
| | 15 | 0.21 | 0.14 | 0.68 | 0.014 | 0.005 | 0.73 | 0.0019 | 0.025 | 0.013* | 0.0037 | |
| | 16 | 0.27 | 0.07 | 0.99 | 0.006 | 0.004 | 0.12* | 0.0022 | 0.024 | 0.044 | 0.0046 | |
| | 17 | 0.30 | 0.04 | 1.11* | 0.008 | 0.005 | 0.28* | 0.0018 | 0.032 | 0.030 | 0.0032 | |
| | 18 | 0.25 | 0.08 | 0.40 | 0.020* | 0.008 | 0.67 | 0.0020 | 0.025 | 0.035 | 0.0038 | |
| | 19 | 0.24 | 0.11 | 0.52 | 0.006 | 0.023* | 0.51 | 0.0025 | 0.020 | 0.032 | 0.0041 | |
| | 20 | 0.23 | 0.14 | 0.32 | 0.009 | 0.010 | 1.50* | 0.0021 | 0.040 | 0.041 | 0.0044 | |
| | 21 | 0.35 | 0.22* | 0.85 | 0.012 | 0.010 | 1.11 | —* | 0.035 | —* | 0.0062 | Mo: 0.16* |

The asterisked data are outside the inventive range.

TABLE 2

| | Symbol | Steel No. | Heating temperature for rolling (° C.) | Rate of cooling after rolling (° C./s) | Number of carbonitrides | Grain coarsening temperature (° C.) |
|---|---|---|---|---|---|---|
| | Inventive range | | ≧1050 | ≦2.0 | ≧20 | |
| Invention | A | 1 | 1250 | 0.5 | 74 | 960 |
| | B | 2 | 1290 | 0.1 | 98 | 1000 |
| | C | 3 | 1225 | 0.7 | 64 | 970 |
| | D | 4 | 1200 | 2.0 | 68 | 960 |
| | E | 5 | 1050 | 0.6 | 40 | 950 |
| | F | 6 | 1320 | 1.0 | 55 | 950 |
| | G | 7 | 1230 | 0.1 | 86 | 950 |
| | H | 8 | 1270 | 0.4 | 76 | 960 |
| | I | 9 | 1260 | 0.3 | 81 | 990 |
| | J | 10 | 1225 | 0.1 | 79 | 950 |
| | K | 11 | 1090 | 0.1 | 61 | 920 |
| | L | 12 | 1280 | 0.6 | 97 | 980 |
| | M | 13 | 1300 | 0.2 | 101 | 1010 |

TABLE 2-continued

| | Symbol | Steel No. | Heating temperature for rolling (° C.) | Rate of cooling after rolling (° C./s) | Number of carbonitrides | Grain coarsening temperature (° C.) |
|---|---|---|---|---|---|---|
| Comparison | N | 14* | 1260 | 0.5 | 6* | 850 |
| | O | 15* | 1225 | 0.9 | 8* | 850 |
| | P | 16* | 1225 | 0.8 | 55 | 970 |
| | Q | 17* | 1150 | 1.2 | 63 | 950 |
| | R | 18* | 1225 | 0.4 | 76 | 950 |
| | S | 19* | 1075 | 0.7 | 51 | 930 |
| | T | 20* | 1275 | 0.3 | 43 | 920 |
| | U | 21* | 1050 | 1.5 | — | 960 |
| | V | 1 | 950* | 0.7 | 3* | 860 |
| | W | 1 | 1225 | 3.0* | 4* | 870 |
| | X | 2 | 990* | 0.2 | 9* | 880 |
| | Y | 3 | 1000* | 0.5 | 6* | 880 |
| | Z | 4 | 1250 | 2.7* | 11* | 890 |

Note 1) The asterisked data are outside the inventive range.
2) Carbonitrides: Total number of at least one of TiC, Ti(CN), NbC, Nb(CN) and (Nb, Ti)(CN) not greater than 0.2 $\mu$m in diameter.

TABLE 3

| | Symbol | Steel No. | Tempering temperature (° C.) | Tensile strength (MPa) | Grain size No. | Delayed fracture strength ratio |
|---|---|---|---|---|---|---|
| Invention | A | 1 | 300 | 1360 | 10.0 | 0.63 |
| | B | 2 | 300 | 1355 | 11.0 | 0.52 |
| | C | 3 | 300 | 1354 | 9.8 | 0.61 |
| | D | 4 | 280 | 1340 | 9.8 | 0.55 |
| | E | 5 | 380 | 1337 | 9.5 | 0.60 |
| | F | 6 | 300 | 1351 | 9.7 | 0.51 |
| | G | 7 | 310 | 1355 | 9.8 | 0.62 |
| | H | 8 | 290 | 1344 | 10.2 | 0.60 |
| | I | 9 | 310 | 1356 | 11.8 | 0.63 |
| | J | 10 | 290 | 1356 | 10.1 | 0.60 |
| | K | 11 | 290 | 1349 | 12.0 | 0.51 |
| | L | 12 | 310 | 1351 | 10.1 | 0.58 |
| | M | 13 | 290 | 1346 | 11.5 | 0.54 |
| Com-parison | N | 14* | 300 | 1339 | 7.2 + 2.0 | 0.33 |
| | O | 15* | 310 | 1336 | 7.5 + 1.0 | 0.43 |
| | P | 16* | 290 | 1355 | 9.0 | 0.22 |
| | Q | 17* | 320 | 1350 | 9.5 | 0.34 |
| | R | 18* | 310 | 1345 | 9.3 | 0.45 |
| | S | 19* | 300 | 1339 | 8.7 | 0.37 |
| | T | 20* | 360 | 1348 | 9.0 | 0.40 |
| | U | 21* | 500 | 1342 | 8.9 | 0.50 |
| | V | 1 | 300 | 1364 | 6.9 + 2.6 | 0.41 |
| | W | 1 | 300 | 1360 | 3.9 | 0.39 |
| | X | 2 | 300 | 1367 | 8.0 + 1.5 | 0.34 |
| | Y | 3 | 280 | 1356 | 7.6 + 1.0 | 0.40 |
| | Z | 4 | 380 | 1358 | 8.3 + 1.5 | 0.36 |

Note: The asterisked data are outside the inventive range.

TABLE 4

| | Symbol | Steel No. | Tempering temperature (° C.) | Tensile strength (MPa) | Grain size No. | Delayed fracture strength ratio |
|---|---|---|---|---|---|---|
| Invention | A | 1 | 370 | 1207 | 10.0 | 0.73 |
| | B | 2 | 370 | 1202 | 11.0 | 0.68 |
| | C | 3 | 370 | 1200 | 9.8 | 0.71 |
| | D | 4 | 340 | 1208 | 9.8 | 0.73 |
| | E | 5 | 440 | 1205 | 9.5 | 0.74 |
| | F | 6 | 370 | 1197 | 9.7 | 0.72 |
| | G | 7 | 380 | 1202 | 9.8 | 0.74 |
| | H | 8 | 350 | 1213 | 10.2 | 0.72 |

TABLE 4-continued

| | Symbol | Steel No. | Tempering temperature (° C.) | Tensile strength (MPa) | Grain size No. | Delayed fracture strength ratio |
|---|---|---|---|---|---|---|
| | I | 9 | 380 | 1202 | 11.8 | 0.73 |
| | J | 10 | 360 | 1202 | 10.1 | 0.73 |
| | K | 11 | 350 | 1217 | 12.0 | 0.66 |
| | L | 12 | 380 | 1197 | 10.1 | 0.71 |
| | M | 13 | 360 | 1193 | 11.5 | 0.69 |

What is claimed is:

1. A cold forging steel excellent in grain coarsening prevention and delayed fracture resistance comprising, in weight percent:

C: 0.10–0.40%,

Si: not more than 0.15%

Mn: 0.30–1.00%,

Cr: 0.50–1.20%,

B: 0.0003–0.0050%,

Ti: 0.020–0.100%,

P: not more than 0.015% (including 0%),

S: not more than 0.015% (including 0%),

N: not more than 0.0100% (including 0%), and the balance of Fe and unavoidable impurities, the steel matrix including particles of not greater than 0.2 $\mu$m diameter of one or both of TiC and Ti(CN) in a total number of not less than 20/100 $\mu m^2$.

2. A cold forging steel excellent in grain coarsening prevention and delayed fracture resistance comprising, in weight percent:

C: 0.10–0.40%,

Si: not more than 0.15%,

Mn: 0.30–1.00%,

Cr: 0.50–1.20%,

B: 0.0003–0.0050%,

Ti: 0.020–0.100%,

Nb: 0.003–0.100%,

P: not more than 0.015% (including 0%),

S: not more than 0.015% (including 0%),

N: not more than 0.0100% (including 0%), and the balance of Fe and unavoidable impurities, the steel matrix including particles of not greater than 0.2 $\mu$m diameter of one or more of TiC, Ti(CN), NbC, Nb(CN) and (Nb, Ti)(CN) in a total number of not less than 20/100 $\mu m^2$.

3. A cold forging steel excellent in grain coarsening prevention and delayed fracture resistance according to claim 1 or 2, further comprising, in weight percent:

V: 0.05–0.30%, and

Zr: 0.003–0.100%, the steel matrix including particles of not greater than 0.2 $\mu$m diameter of one or more of TiC, Ti(CN), NbC, Nb(CN) and (Nb, Ti)(CN) in a total number of not less than 20/100 $\mu m^2$.

4. A method of producing a cold forging steel excellent in grain coarsening prevention and delayed fracture resistance comprising the steps of:

heating a steel having a composition of any of claims 1 to 3 to not lower than 1050° C., hot-rolling the steel into steel wire or steel bar, and slowly cooling the steel at a cooling rate of not greater than 2° C./s during cooling to a temperature not higher than 600° C. to obtain a steel having dispersed in a matrix thereof particles of not greater than 0.2 $\mu$m diameter of one or more of TiC, Ti(CN), NbC, Nb(CN) and (Nb, Ti)(CN) in a total number of not less than 20/100 $\mu m^2$.

* * * * *